US010596840B2

(12) United States Patent
Takenaka et al.

(10) Patent No.: US 10,596,840 B2
(45) Date of Patent: Mar. 24, 2020

(54) LIQUID DISCHARGING DEVICE

(71) Applicant: SEIKO EPSON CORPORATION, Tokyo (JP)

(72) Inventors: Ryota Takenaka, Matsumoto (JP); Hiroki Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/285,521

(22) Filed: Feb. 26, 2019

(65) Prior Publication Data

US 2019/0263155 A1 Aug. 29, 2019

(30) Foreign Application Priority Data

Feb. 26, 2018 (JP) ..... 2018-031644

(51) Int. Cl.
*B41J 15/16* (2006.01)

(52) U.S. Cl.
CPC ..... *B41J 15/16* (2013.01)

(58) Field of Classification Search
CPC ..... B41J 15/16
See application file for complete search history.

(56) References Cited

U.S. PATENT DOCUMENTS 9,925,796 B2 * 3/2018 Hegarty ..... B41J 2/355
2015/0352864 A1 12/2015 Tanaka
2016/0355035 A1 * 12/2016 Campanini ..... B65H 29/52

FOREIGN PATENT DOCUMENTS

JP 2016-052774 A 4/2016

* cited by examiner

*Primary Examiner* — Lamson D Nguyen
(74) *Attorney, Agent, or Firm* — Workman Nydegger

(57) ABSTRACT

A liquid discharging device including a transporting unit configured to transport a medium in a transport direction, a winding unit disposed on a downstream side of the transporting unit in the transport direction and configured to wind the medium, a recording head disposed between the transporting unit and the winding unit and configured to discharge ink onto the medium positioned in a discharge range, a medium supporting unit configured to support the medium positioned in the discharge range, and a medium guide unit disposed on a downstream side of the medium supporting unit in the transport direction, and heated by a heater, and moreover including a curved portion curved in a direction away from the recording head, wherein the curved portion includes a curved portion side convex portion group including curved portion side convex portions projecting in a direction approaching the recording head and arranged in an X direction.

6 Claims, 8 Drawing Sheets

LIQUID DISCHARGING DEVICE

BACKGROUND

1. Technical Field

The invention relates to a liquid discharging device.

2. Related Art

There has been proposed, for example, an ink jet printer (printing apparatus) using roll paper as a medium (JP-A-2016-52774).

The printing apparatus described in JP-A-2016-52774 includes a medium placement unit on which a roll medium (roll paper) is placed, a transporting unit configured to transport a medium unwound from the roll paper in a sub-scanning direction (transport direction), an ink head configured to discharge ink, a winding unit configured to wind the medium transported, a dancer roller configured to apply predetermined tension to the medium, and a rod-like member configured to press the medium to change a transport path of the medium.

In the printing apparatus described in JP-A-2016-52774, the ink head discharges ink onto the medium supported by a platen (medium supporting unit) to form a desired image, and the rod-like member changes the transport path of the medium to eliminate a skew of the medium.

When the ink head discharges ink onto the medium and the medium absorbs moisture of the ink, the medium swells. Further, when the swelling of the medium advances and strain associated with the swelling of the medium accumulates in the medium, a wrinkle (a portion of the medium floating significantly upward from the medium supporting unit) occurs in the medium, and in addition, the wrinkle grows to an upstream side or a downstream side in the transport direction.

In the printing apparatus described in JP-A-2016-52774, when the wrinkle of the medium reaches a discharge region of the ink, the wrinkle of the medium (the portion of the medium floating significantly upward from the medium supporting unit) and the ink head interfere, and there has been a possibility of occurrence of a defect such as contamination of the medium or a defect such as a failure of the ink head. Further, when the medium is wound in a state where the wrinkle has occurred in the medium, there has been a possibility of occurrence of a defect such as occurrence of a fold in the medium wound or a defect such as disturbance in a winding shape of the medium.

SUMMARY

A liquid discharging device according to an aspect of the invention includes a transporting unit configured to transport a medium in a first direction, a winding unit disposed on a downstream side in the first direction of the transporting unit and configured to wind the medium, a discharging unit disposed between the transporting unit and the winding unit and configured to discharge a liquid onto the medium positioned in a discharge range, a first supporting unit disposed to face the discharging unit and configured to support the medium, and a second supporting unit disposed on a downstream side in the first direction of the first supporting unit, heated by a heater, and including a curved portion curved in a direction away from the discharging unit, and in the liquid discharging device, the curved portion includes a curved portion side convex portion group including curved portion side convex portions arranged in a second direction intersecting the first direction.

According to another aspect of the invention, in the liquid discharging device, preferably the first supporting unit includes a first portion configured to support the medium positioned in the discharge range, and a second portion positioned on a downstream side in the first direction of the discharge range, and the second portion includes a second portion side convex portion group including second portion side convex portions arranged in the second direction, and a suction hole provided between one of the second portion side convex portions arranged in the second direction and a second portion side convex portion adjacent to the one of the second portion side convex portions.

According to a further aspect of the invention, in the liquid discharging device, preferably the curved portion side convex portions and the second portion side convex portions are disposed in a staggered pattern to positionally differ in the second direction.

According to a still further aspect of the invention, in the liquid discharging device, preferably the first supporting unit includes a first portion positioned in the discharge range, and a second portion positioned on the downstream side in the first direction of the discharge range, and the first portion includes a first portion side convex portion group including first portion side convex portions arranged in the second direction, and a suction hole provided between one of the first portion side convex portions arranged in the second direction and a first portion side convex portion adjacent to the one of the first portion side convex portions.

According to a still further aspect of the invention, in the liquid discharging device, preferably the curved portion side convex portions and the first portion side convex portions are disposed in a staggered pattern to positionally differ in the second direction.

According to a still further aspect of the invention, in the liquid discharging device, preferably the curved portion side convex portion group includes a first curved portion side convex portion group and a second curved portion side convex portion group disposed on a downstream side in the first direction of the first curved portion side convex portion group, and first curved portion side convex portions of the first curved portion side convex portion group and second curved portion side convex portions of the second curved portion side convex portion group are disposed in a staggered pattern to positionally differ in the second direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention are described below with reference to the accompanying drawings. The exemplary embodiments each illustrate an aspect of the invention, and do not limit the invention in any way. The exemplary embodiments can be changed as desired without departing from the scope of the technical concept of the invention. Moreover, in each of the following figures, to make each layer, and each portion recognizable in terms of size, each of them is illustrated at a scale different from an actual scale.

Exemplary Embodiment 1

Overview of Printing Apparatus

Figure 1:
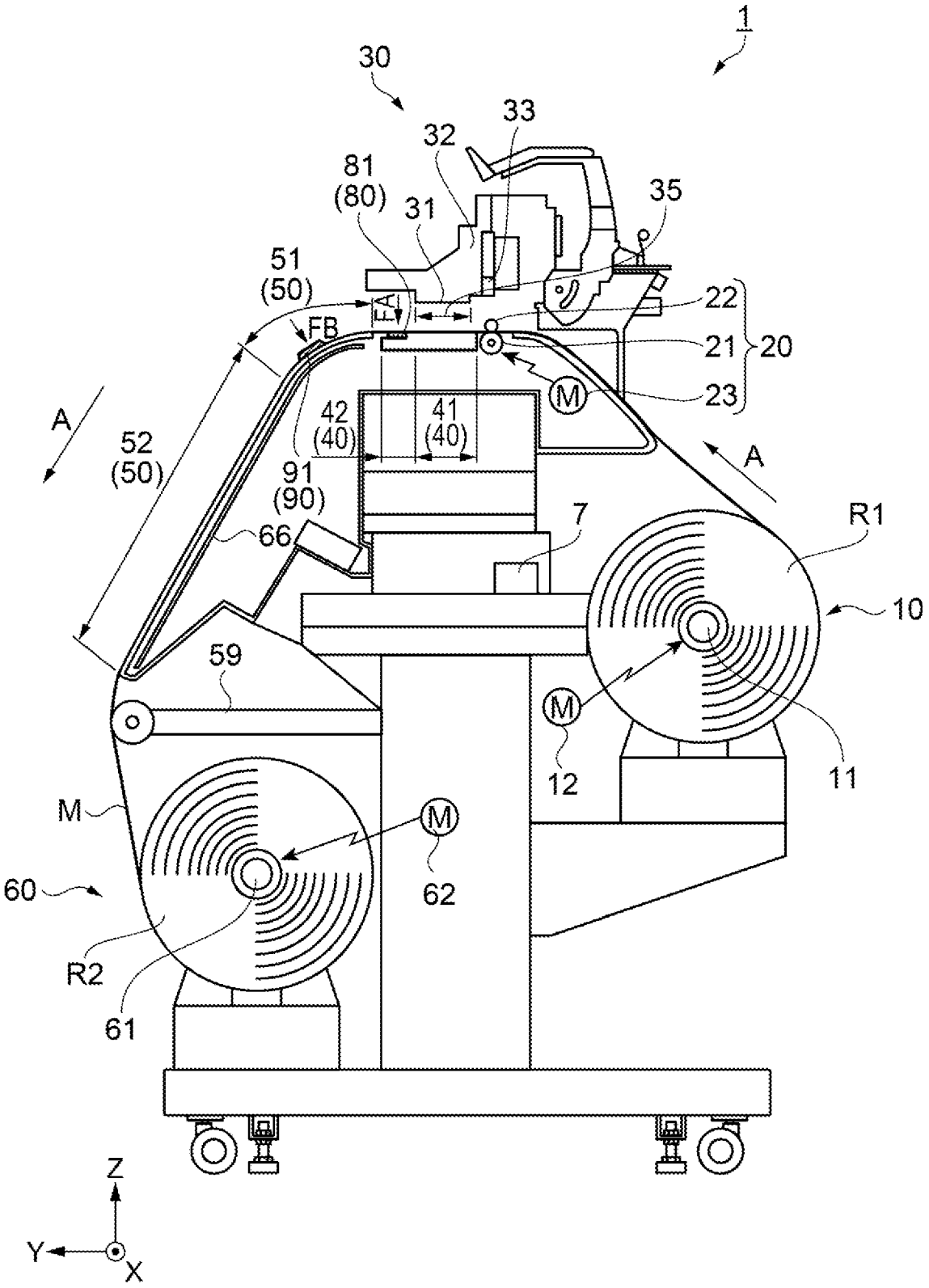
FIG. 1 illustrates a schematic side view of a printing apparatus according to Exemplary Embodiment 1.

FIG. 1 is a schematic side view of a printing apparatus according to Exemplary Embodiment 1.

First, an overview of a printing apparatus 1 according to the exemplary embodiment is described with reference to FIG. 1.

As illustrated in FIG. 1, the printing apparatus 1 according to the exemplary embodiment is an example of a "liquid discharging device", and is a large format printer (LFP) configured to handle an elongated medium M. The printing apparatus 1 includes a feeding unit 10, a transporting unit 20, a recording unit 30 (recording head 31), a medium supporting unit 40, a medium guide unit 50, a rotating bar member 59, and a winding unit 60 disposed in order along a transport direction A of the medium M. Further, the printing apparatus 1 includes a control unit 7.

Note that the transport direction A is an example of a "first direction".

The medium M is wound into a roll shape onto the feeding unit 10 and the winding unit 60 in a state where tension is applied to the medium M. The medium M is fed out from the feeding unit 10 and passes through the transporting unit 20. After printing (recording) is performed by the recording unit 30, the medium M is wound by the winding unit 60. As the medium M, roll-shaped transfer paper for sublimation transfer is used.

An image formed on the medium M (transfer paper) can be sublimation-transferred to another printing medium such as fabric by superimposing the medium M (transfer paper) on which the image is formed by the printing apparatus 1 onto another printing medium such as fabric, and pressurizing and heating the medium M (transfer paper).

The feeding unit 10 feeds the medium M to the transporting unit 20.

A roll body R1 formed of the medium M wound into a roll shape is set in the feeding unit 10. The feeding unit 10 includes a feeding-side supporting unit 11 and a feeding motor 12. The feeding-side supporting unit 11 rotatably supports the roll body R1. The feeding motor 12 is a driving source configured to rotate the roll body R1. When the feeding motor 12 is operated, the roll body R1 rotates in a feeding direction, and the medium M is fed out of the roll body R1 in the transport direction A.

The transporting unit 20 transports the medium M in the transport direction A, and the medium M fed out of the feeding unit 10 is fed out to the recording unit 30.

The transporting unit 20 includes a driving roller 21, a driven roller 22, and a power factor (PF) motor 23. The driven roller 22 is pressed against the driving roller 21 through the medium M and is rotationally driven. The driving roller 21 pinches the medium M between itself and the driven roller 22. The driving roller 21 is rotationally driven by the PF motor 23 to transport the medium M in the transport direction A.

The recording unit 30 (recording head 31) is disposed between the transporting unit 20 and the winding unit 60, and discharges ink being an example of a "liquid", onto the medium M positioned in a discharge range 35.

The recording unit 30 includes a recording head 31 being an example of a "discharging unit", a carriage 32, and a guide rail 33. The recording head 31 is an inkjet head including a plurality of nozzles configured to discharge ink. The recording head 31 is disposed between the transporting unit 20 and the winding unit 60, discharges ink onto the medium M positioned in the discharge range 35, and records (prints) an image on the medium M fed out from the transporting unit 20. The guide rail 33 extends in a width direction of the medium M intersecting with the transport direction A, and supports the carriage 32. The carriage 32 is equipped with the recording head 31, and reciprocates along the width direction of the medium M by a carriage motor (not illustrated).

The medium supporting unit 40 is an example of a "first supporting unit", is disposed to face the recording head 31, and supports the medium M. The medium supporting unit 40 includes a first portion 41 configured to support the medium M positioned in the discharge range 35, and a second portion 42 positioned on a downstream side in the transport direction A of the discharge range 35. Further, the medium supporting unit 40 includes a suction mechanism (not illustrated) configured to create a negative pressure.

The first portion 41 includes suction holes 47 (refer to FIG. 2), and the suction mechanism is driven to suction and support the medium M via the suction holes 47 in the first portion 41. The second portion 42 includes second portion side convex portions 81 and suction holes 82 (refer to FIG. 2), and the suction mechanism is driven to suction and support the medium M via the suction holes 82 in the second portion 42. In the second portion 42, the suction mechanism is driven to cause force FA pressing the medium M against the second portion side convex portions 81 to act on the medium M.

Details of the medium supporting unit 40 will be described later.

The printing apparatus 1 prints a predetermined image on the medium M by alternately repeating a droplet discharge operation in which the recording head 31 discharges ink as ink droplets while the recording head 31 moves in the width direction of the medium M, and a feeding operation in which the transporting unit 20 moves the medium M in the transport direction A.

Note that, while the exemplary embodiment illustrates, as an example of the recording head 31, a serial-head type recording head configured to discharge ink while the recording head moves in the width direction of the medium M, the recording head 31 may be a line head-type recording head configured to discharge ink in a state where the recording head extends and is fixed in the width direction of the medium M.

The medium guide unit 50 is an example of a "second supporting unit", is disposed on a downstream side in the transport direction A of the medium supporting unit 40, supports the medium M, and guides the medium M fed out from the recording unit 30 to the winding unit 60. The medium guide unit 50 includes a curved portion 51 and a flat portion 52. The curved portion 51 is positioned on an upstream side in the transport direction A of the flat portion 52, and curves in a direction away from the recording head 31. A surface of the curved portion 51 coming into contact with the medium M is a curved surface. Curved portion side convex portions 91 protruding in a direction approaching the recording head 31 are provided in the curved portion 51. The flat portion 52 is positioned on a downstream side in the transport direction A of the curved portion 51, and is flat without curvature. A surface of the flat portion 52 coming into contact with the medium M is a flat surface.

In other words, the medium guide unit 50 is disposed on a downstream side in the transport direction A of the medium guide unit 40, and includes the curved portion 51 curved in a direction away from the recording head 31.

The medium M is disposed between the feeding unit 10 and the winding unit 60 in a state where tension is applied to the medium M. That is, the medium M is stretched along a transport path, and the medium guide unit 50 forms the transport path of the medium M. When the medium M is disposed in the curved portion 51 curved, in a state where tension is applied to the medium M, force pressing the medium M against the medium guide unit 50 acts on the medium M. Therefore, in the curved portion 51, force FB pressing the medium M against the curved portion side convex portions 91 acts on the medium M.

According to the exemplary embodiment, the curved portion side convex portions 91 are provided in the curved portion 51 to cause the force FB pressing the medium M against the curved portion side convex portions 91 to act on the medium M.

The curved portion side convex portions 91 may be provided in a portion where the force pressing the medium M against the medium 50 acts. For example, the curved portion side convex portions 91 may be provided in the flat portion 52. When the curved portion side convex portions 91 are provided in the flat portion 52, preferably a suction hole is provided in the flat portion 52, the medium M is suctioned and supported via the suction hole in the flat portion 52, and the medium M is pressed against the flat portion 52.

A heater 66 is attached to a surface of the medium guide unit 50 on the side opposite to the medium M. The heater 66 is, for example, a tube heater, and is attached via aluminum tape or the like to the surface of the medium guide unit 50 on the side opposite to the medium M. Then, the heater 66 is driven to heat by thermal conduction a surface of the medium guide unit 50 supporting the medium M.

That is, the medium guide unit 50 is heated by the heater 66, and guides the medium M to the winding unit 60, and in addition, heats the medium M, and dries ink discharged onto the medium M.

The rotating bar member 59 abuts the medium M, and is provided between the medium guide unit 50 and the winding unit 60. The rotating bar member 59 extends in the width direction of the medium M, and a rotary shaft of the rotating bar member 59 is fixed to and supported by a main body of the printing apparatus 1. The rotating bar member 59 rotates in association with movement of the medium M on which the rotating bar member 59 abuts on the medium M and supports the movement of the medium M.

The winding unit 60 is disposed on a downstream side in the transport direction A of the transporting unit 20, and winds the medium M.

The winding unit 60 includes a winding-side supporting unit 61 and a winding motor 62, and winds the medium M fed out of the recording unit 30 into a roll shape. A leading end of the medium M is attached to the winding-side supporting unit 61. The winding-side supporting unit 61 rotates by power transmitted from the winding motor 62. That is, the winding motor 62 is a driving source to rotate the winding-side supporting unit 61. When the winding motor 62 rotates in one direction, the winding-side supporting unit 61 rotates in a winding direction, and the medium M is wound to form a roll body R2.

The control unit 7 controls each unit of the printing apparatus 1.

The control unit 7 includes memory, and a tension function optimizing tension applied to the medium M is stored in the memory. The control unit 7 controls, for example, a rotational speed of the winding motor 62 and adjusts tension acting on the medium M between the transporting unit 20 and the winding unit 60, on the basis of computation results using the tension function.

In the printing apparatus 1, the driving roller 21 is rotationally driven to cause force pressing in the transport direction A to be applied to the medium M, and the roll body R2 is rotationally driven to cause force pulling in the transport direction A to be applied to the medium M. The medium M is transported from the transporting unit 20 toward the winding unit 60 by this pressing force and this pulling force.

Core members of the driving roller 21 and the roll body R2 are mechanically processed, and thus have a tolerance (error) with respect to design dimensions, and eccentricity may occur in the core members of the driving roller 21 and the roll body R2. Further, the core members of the driving roller 21 and the roll body R2 are mechanically attached, and thus also have a tolerance (error) in an attachment position with respect to a design position, and rotation shafts of the core members of the driving roller 21 and the roll body R2 may be disposed obliquely with respect to the width direction of the medium M.

Then, the pushing force of the driving roller 21 on the medium M and the pulling force of the roll body R2 on the medium M become non-uniform, and as a result, tension in an oblique direction (tension in a direction intersecting the transport direction A) acts on the medium M, and the medium M becomes skewed in a direction intersecting the transport direction A.

The printing apparatus 1 includes an edge sensor (not illustrated) configured to detect a position of an end portion of the medium M, and the control unit 7 corrects a skew of the medium M on the basis of a detection result of the end portion position of the medium M.

In the following description, the width direction of the medium M is referred to as an X direction, a height direction of the printing apparatus 1 is referred to as a Z direction, and a direction intersecting the X direction and the Z direction is referred to as a Y direction. Further, a leading-end side of an arrow indicating the direction is defined as a (+) direction, and a base-end side of the arrow indicating the direction is defined as a (−) direction.

Note that the X direction is an example of a "second direction".

Overview of Medium supporting unit and Medium Guide Unit

Figure 2:
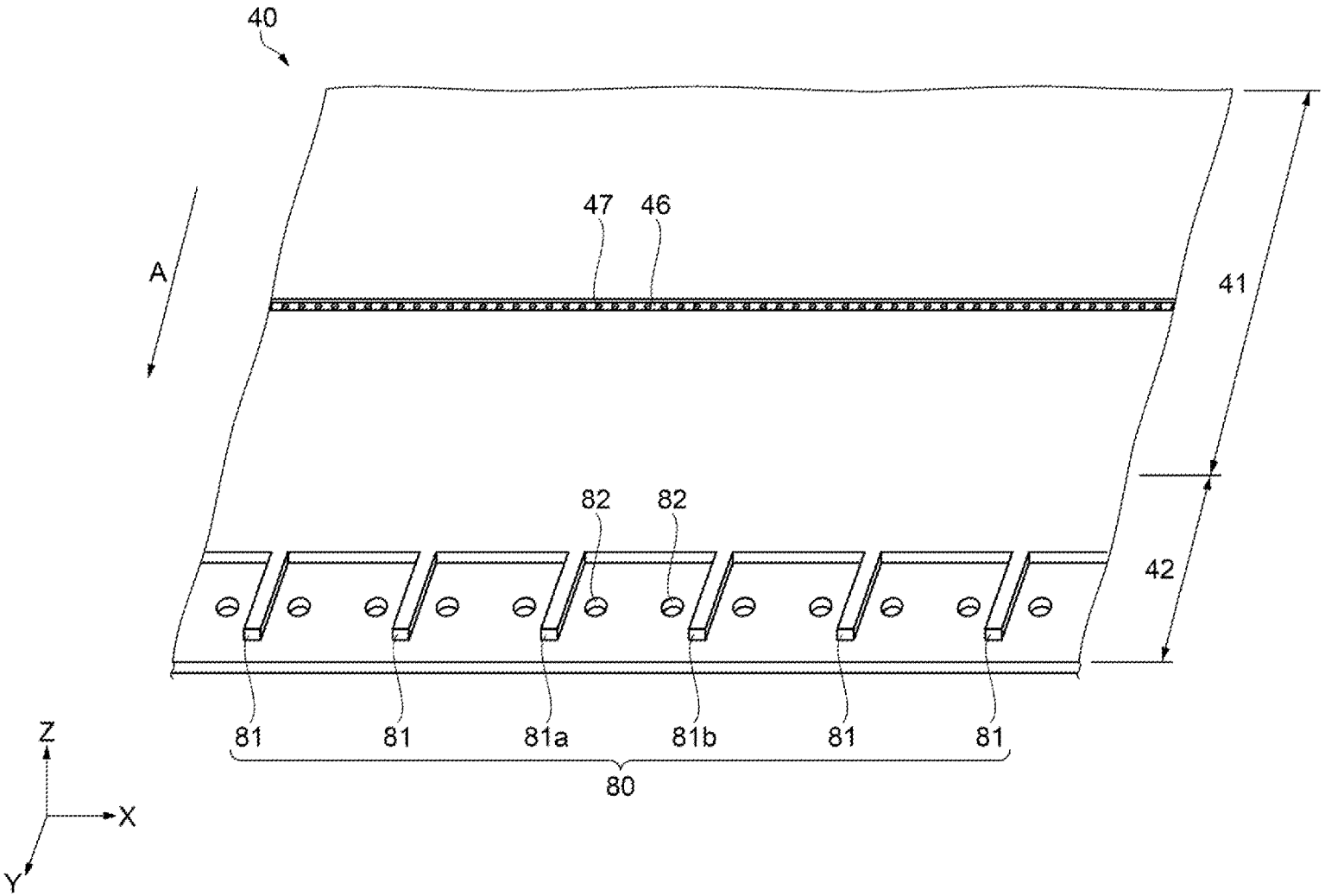
FIG. 2 illustrates a partial perspective view of a medium supporting unit.
Figure 3:
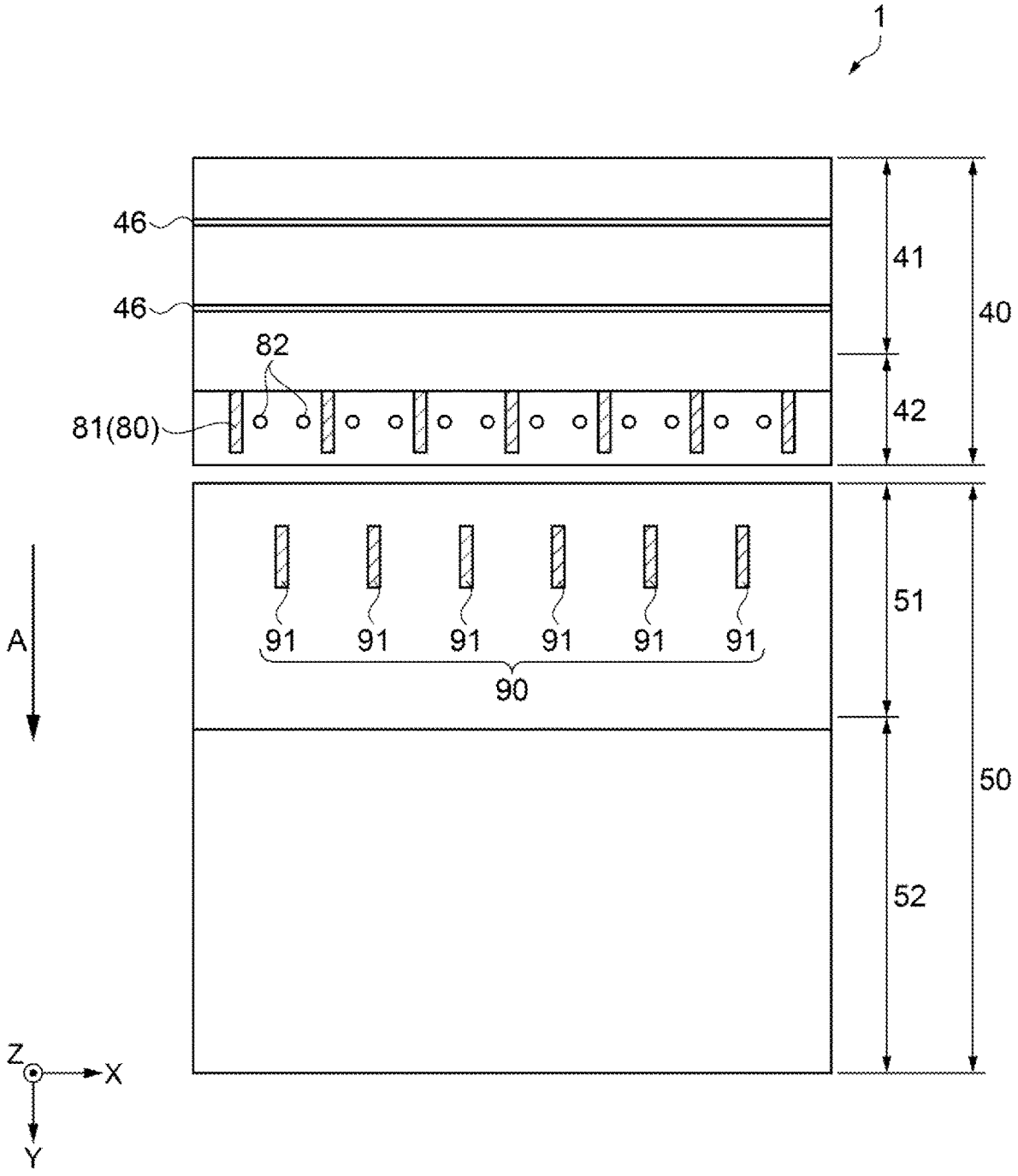
FIG. 3 is a schematic view illustrating a state of the medium supporting unit and a medium guide unit as viewed from a Z direction side.

FIG. 2 is a partial perspective view of the medium supporting unit. FIG. 3 is a schematic view illustrating a state of the medium supporting unit and the medium guide unit as viewed from the Z direction side.

Note that, in FIG. 3, the second portion side convex portions 81 and the curved portion side convex portions 91 are marked by hatching, and the suction holes 47 are not illustrated.

As illustrated in FIG. 2, the medium supporting unit 40 includes the first portion 41 configured to support the medium M positioned in the discharge range 35, and the second portion 42 positioned on a downstream side in the transport direction A of the first portion 41.

No concave and convex portion along the X direction is formed in the first portion 41. According to the configuration in which no concave and convex portion along the X direction is formed in the first portion 41, an interval between the medium M and the recording head 31 is less likely to change in the discharge range 35, as compared to a configuration in which concave and convex portions along the X direction are formed in the first portion 41, and the recording unit 30 can form an image having stabilized quality on the medium M.

Further, groove portions 46 extending in the X direction are provided in the first portion 41, and a plurality of the suction holes 47 passing through the first portion 41 are provided along the X direction in the groove portions 46. The medium M is suctioned and supported via the suction holes 47 in the first portion 41. Thus, upward floating of the medium M from the medium supporting unit 40 (first portion 41) in the discharge range 35 is prevented, and deterioration in printing quality due to the upward floating is prevented.

In the second portion 42, the side of the second portion 42 coming into contact with the medium M is ground in the Z (−) direction, and thus the second portion side convex portions 81 protruding in a direction approaching the recording head 31 are formed. A position (height) of a surface of a top portion of a second portion side convex portion 81 coming into contact with the medium M is the same as a position (height) of a surface of the first portion 41 coming into contact with the medium M. Note that the position of the surface of the top portion of the second portion side convex portion 81 coming into contact with the medium M may be configured to be different from the position of the surface of the first portion 41 coming into contact with the medium M. For example, the surface of the top portion of the second portion side convex portion 81 coming into contact with the medium M may be configured to be higher than the surface of the first portion 41 coming into contact with the medium M.

As viewed from the Z (+) direction side, the second portion side convex portion 81 has a rectangular shape having a dimension in the Y direction of the second portion side convex portion 81 longer than a dimension in the X direction of the second portion side convex portion 81, and a plurality of the second portion side convex portions 81 are provided along the X direction. The plurality of second portion side convex portions 81 provided along the X direction form a second portion side convex portion group 80.

In other words, the second portion 42 includes the second portion side convex portion group 80 including the second portion side convex portions 81 protruding in the direction approaching the recording head 31 and arranged in the X direction.

A second portion side convex portion 81*a* in FIG. 2 is an example of "one of the second portion side convex portions arranged in the second direction", and is one of the plurality of second portion side convex portions 81 provided along the X direction. A second portion side convex portion 81*b* in FIG. 2 is an example of a "second portion side convex portion adjacent to the one of the second portion side convex portions", and is the second portion side convex portion 81 adjacent to the second portion side convex portion 81*a*.

Two suction holes 82 passing through the second portion 42 are provided between the second portion side convex portion 81*a* and the second portion side convex portion 81*b*. In other words, the second portion 42 includes the suction holes 82 provided between the one second portion side convex portion 81*a* of the second portion side convex portions 81 arranged in the X direction, and the second portion side convex portion 81*b* adjacent to the one second portion side convex portion 81*a*. The suction holes 82 are larger than the suction holes 47.

Note that the number of the suction holes 82 provided between the second portion side convex portion 81*a* and the second portion side convex portion 81*b* is not limited to two, and may be singular or may be greater than two.

The medium M is suctioned and supported via the suction holes 82 in the second portion 42 by the driving of the suction mechanism. Since the suction holes 82 are larger than the suction holes 47, the medium M is strongly suctioned via the suction holes 82, as compared to a case where the medium M is suctioned via the suction holes 47. That is, the suction holes 82 larger than the suction holes 47 are provided and thus, it is possible to strengthen the force FA pressing the medium M against the second portion side convex portion 81 side.

As illustrated in FIG. 3, a plurality of the curved portion side convex portions 91 are provided in the X direction in the curved portion 51. As viewed from the Z (+) direction side, each curved portion side convex portion 91 has a rectangular shape, and a dimension in the Y direction of the curved portion side convex portion 91 is longer than a dimension in the X direction of the curved portion side convex portion 91. The plurality of curved portion side convex portions 91 provided along the X direction form a curved portion side convex portion group 90. In other words, the curved portion 51 includes the curved portion side convex portion group 90 including the curved portion side convex portions 91 protruding in the direction approaching the recording head 31 and arranged in the X direction.

Figure 4:
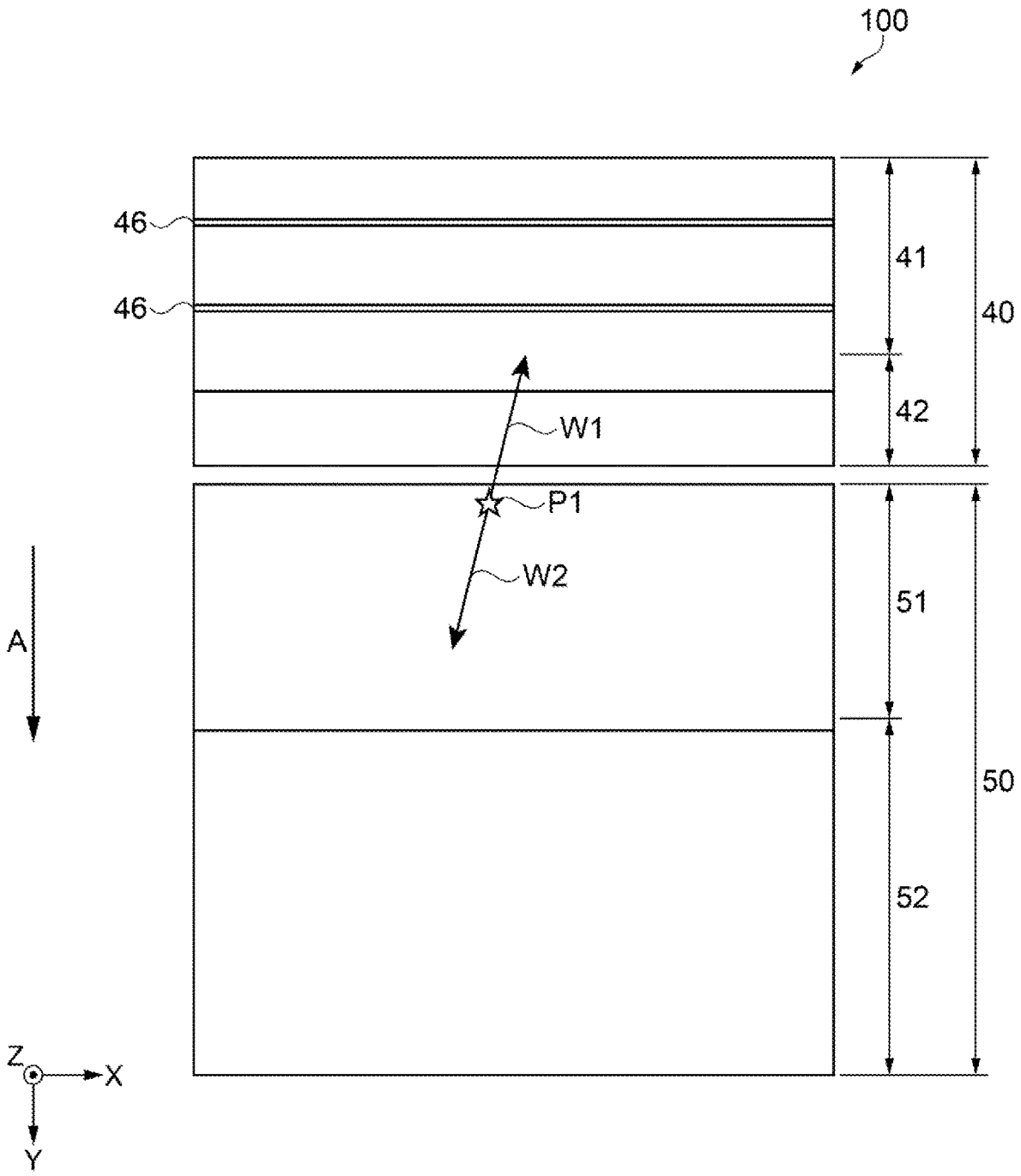
FIG. 4 is a schematic view illustrating a state of a wrinkle occurring in a medium in a medium supporting unit and a medium guide unit of a printing apparatus according to a comparative example.
Figure 5:
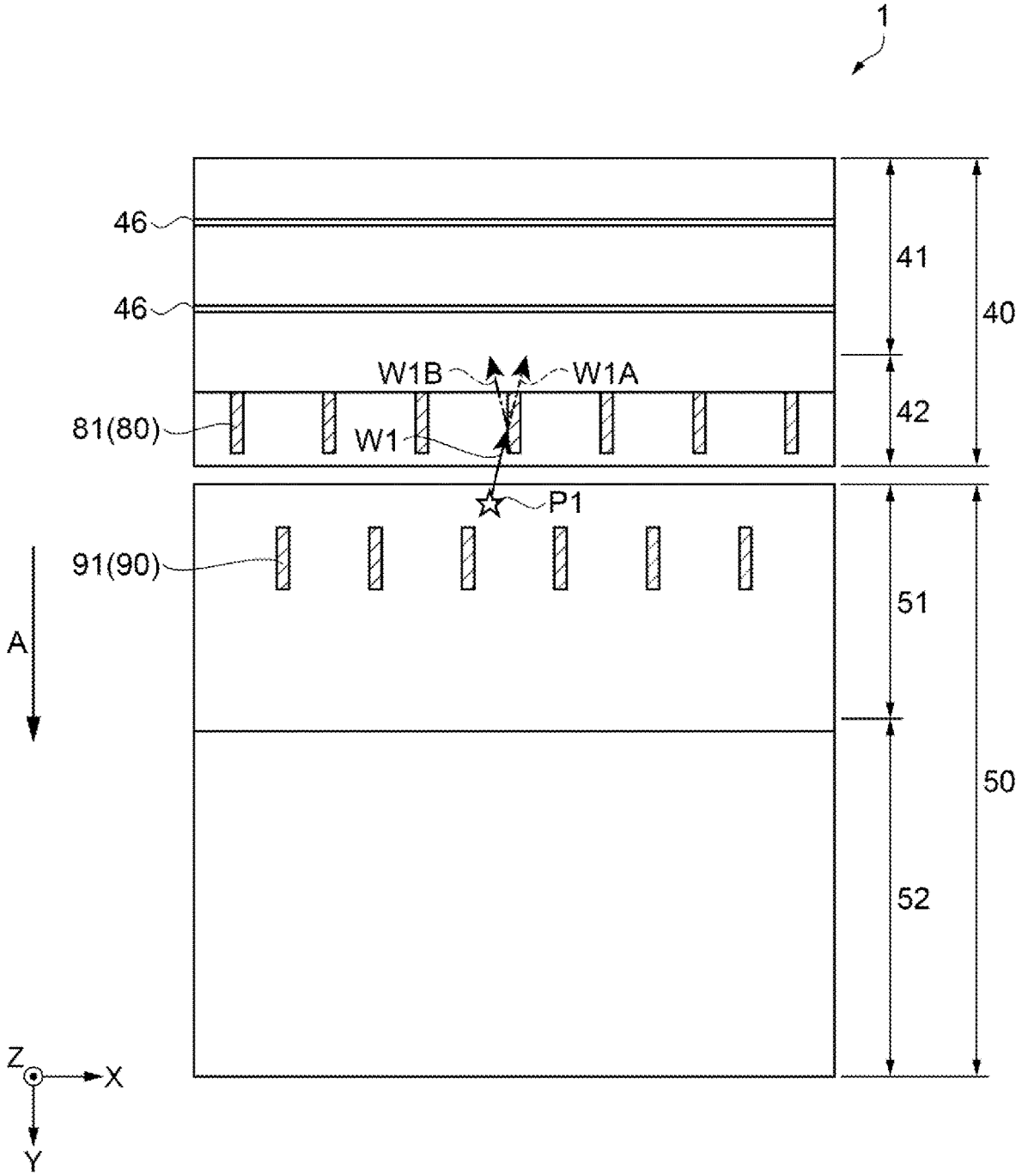
FIG. 5 is a schematic view illustrating a state of a wrinkle occurring in a medium in the medium supporting unit and the medium guide unit of the printing apparatus according to Exemplary Embodiment 1.
Figure 6:
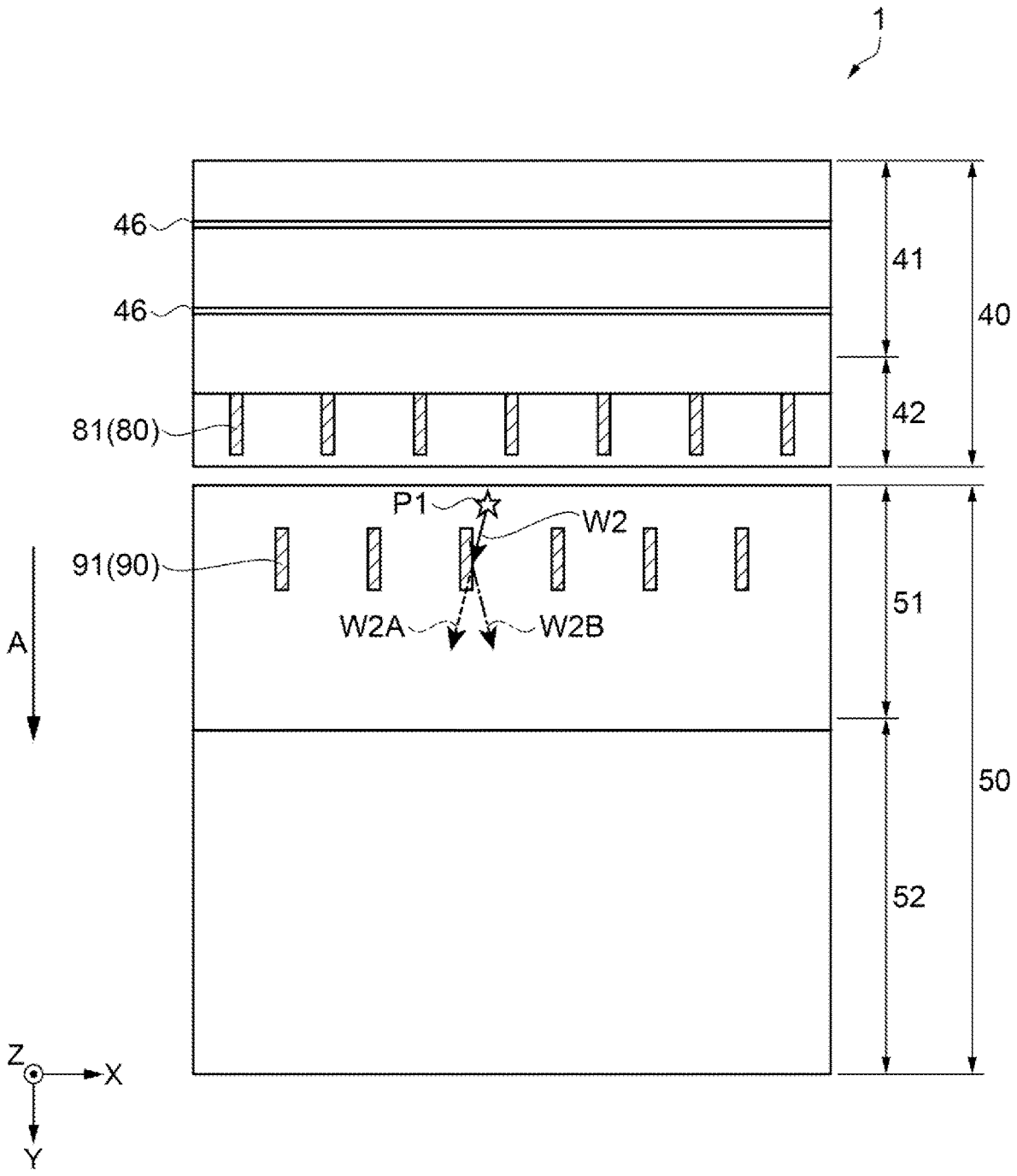
FIG. 6 is a schematic view illustrating a state of a wrinkle occurring in a medium in the medium supporting unit and the medium guide unit of the printing apparatus according to Exemplary Embodiment 1.

Further, the curved portion side convex portions 91 of the curved portion side convex portion group 90, and the second portion side convex portions 81 of the second portion side convex portion group 80 are disposed in a staggered pattern to positionally differ in the X direction. Printing Apparatus Issues and Countermeasures FIG. 4 is a figure corresponding to FIG. 3, and is a schematic view illustrating a state of a wrinkle occurring in a medium in a medium supporting unit and a medium guide unit of a printing apparatus according to a comparative example. FIGS. 5 and 6 are figures corresponding to FIG. 4, and are schematic views each illustrating a state of a wrinkle occurring in a medium in the medium supporting unit and the medium guide unit of the printing apparatus according to the exemplary embodiment.

Note that, in FIGS. 5 and 6, illustration of the suction holes 82 is omitted.

While details will be described later, in an unspecified location (portion) of the medium supporting unit 40 or the medium guide unit 50, the medium M floats upward from the medium supporting unit 40 or the medium guide unit 50, and slight upward floating of the medium M occurs. In the following description, the slight upward floating of the medium M occurring in an unspecified location of the medium supporting unit 40 or the medium guide unit 50 is referred to as initial upward floating of the medium M.

Then, assuming that the portion where the initial upward floating of the medium M occurs is an origin, the upward floating of the medium M grows to the upstream side and the downstream side in the transport direction A, and a wrinkle W is formed in the medium M. In other words, assuming that the portion where the initial upward floating of the medium M occurs is an origin, the wrinkle W occurring in the medium M grows to the upstream side and the downstream side in the transport direction A.

In FIG. 4, assuming that a portion P1 where the initial upward floating of the medium occurs is an origin, a wrinkle W1 growing to the upstream side in the transport direction A and a wrinkle W2 growing to the downstream side in the transport direction A are illustrated by solid arrows. Further, the portion P1 where the initial upward floating of the medium M occurs is indicated by a star.

Similarly, in FIGS. 5 and 6, the same states as in FIG. 4 are illustrated. In FIG. 5, the wrinkle W1 growing to the upstream side in the transport direction A assuming that the portion P1 is an origin is illustrated by a solid arrow. In FIG. 6, the wrinkle W2 growing to the downstream side in the transport direction A assuming that the portion P1 is an origin is illustrated by a solid arrow.

A printing apparatus 100 according to a comparative example does not include the second portion side convex portion group 80 (second portion side convex portions 81) and the curved portion side convex portion group 90 (curved portion side convex portions 91), while the printing apparatus 1 according to the exemplary embodiment includes the second portion side convex portion group 80 (second portion side convex portions 81) and the curved portion side convex portion group 90 (curved portion side convex portions 91). This is a difference between the printing apparatus 100 according to the comparative example and the printing apparatus 1 according to the exemplary embodiment. The printing apparatus 100 according to the comparative example and the printing apparatus 1 according to the exemplary embodiment are the same in other configurations.

The printing apparatus 100 according to the comparative example and the printing apparatus 1 according to the exemplary embodiment (hereinafter referred to as printing apparatuses 1 and 100) discharge ink onto transfer paper (medium M) for sublimation transfer and form an image on the medium M. That is, the printing apparatuses 1 and 100 form on the medium M an image capable of being sublimation-transferred onto another printing medium such as fabric. When the printing apparatuses 1 and 100 form on the medium M an image capable of being sublimation-transferred, a dark image is formed on the medium M, as compared to a case where the printing apparatuses 1 and 100 form a final product on the medium M. That is, when a dark image capable of being sublimation-transferred is formed on the medium M, a clear image (final product) can be formed on another printing medium by sublimation transfer.

Therefore, when the printing apparatuses 1 and 100 form on the medium M an image capable of being sublimation-transferred, a printing duty (printing rate) increases and a significant amount of ink is discharged onto the medium M, as compared to a case where the printing apparatuses 1 and 100 form a final product on the medium M.

The medium M is an assembly of fiber including, for example, fine paper, cast-coated paper, art paper, coated paper, and synthetic paper, and when the medium M absorbs moisture, the medium M swells, and when the medium M loses moisture, the medium M shrinks.

Thus, in a portion where a dark image is formed (in a portion where the printing duty is high), an amount of moisture (moisture in ink) absorbed in the medium M increases, and the swelling of the medium M becomes significant. In a portion where a light image is formed (in a portion where the printing duty is low), an amount of moisture (moisture in ink) absorbed in the medium M decreases, and the swelling of the medium M becomes small.

When the printing apparatuses 1 and 100 form on the medium M an image capable of being sublimation-transferred, the printing duty increases and thus, as compared to a case where the printing duty is low, the medium M significantly swells. Further, the medium M gradually absorbs moisture, and thus the swelling of the medium M advances not only in the discharge range 35 where ink is discharged from the recording head 31, but also on the downstream side in the transport direction A of the discharge range 35.

In the printing apparatuses 1 and 100, since the suction holes 47 (not illustrated in FIG. 4) are provided in the groove portions 46 of the first portion 41, even when the medium M swells in the discharge range 35, the medium M is suctioned and supported via the suction holes 47 in the first portion 41, and thus the upward floating of the medium M from the first portion 41 in the discharge range 35 is suppressed. Therefore, in the first portion 41, the upward floating of the medium M due to the swelling of the medium M is less likely to occur.

However, the medium M gradually absorbs moisture, and thus strain due to the swelling of the medium M accumulates in the medium M on the downstream side in the transport direction A of the discharge range 35. Further, in the curved portion 51 of the medium guide unit 50, the medium M is heated, loses moisture, and shrinks, and thus strain due to the shrinkage of the medium M accumulates in the medium M. Therefore, in the second portion 42 positioned on the downstream side in the transport direction A of the discharge range 35 and the curved portion 51 of the medium guide unit 50, the medium M is in a state where the strain has accumulated.

Note that, in the curved portion 51 positioned on the upstream side in the transport direction A of the flat portion 52, drying of the medium M advances, and the shrinkage of the medium M is likely to occur. In the flat portion 52 positioned on the downstream side in the transport direction A of the curved portion 51, drying of the medium M has already advanced in the curved portion 51, and thus the shrinkage of the medium M due to the drying of the medium M is less likely to occur. Therefore, the strain due to the shrinkage of the medium M is likely to accumulate in the curved portion 51, and is less likely to accumulate in the flat portion 52.

When the upward floating of the medium M occurs in an unspecified portion of the second portion 42 and the curved portion 51, an adverse effect of the strain accumulated in the medium M becomes significant, and the wrinkle W (wide range upward floating of the medium M) grows to the upstream side and the downstream side in the transport direction A, assuming that the portion where the upward floating of the medium M occurs is an origin. Further, the wrinkle W grows in a direction in which tension acts.

The upward floating of the medium M being an origin of the growth of the wrinkle W is likely to occur in the portion (second portion 42, curved portion 51) where the strain accumulates in the medium M. Therefore, the wrinkle W grows to the upstream side and the downstream side in the transport direction A, assuming that the upward floating of the medium M occurring in an unspecified portion of the second portion 42 or the curved portion 51 is an origin.

As illustrated in FIG. 4, in the printing apparatus 100 according to the comparative example, the initial upward floating of the medium M occurs in the portion P1 illustrated by a star in the figure. Then, the wrinkle W1 grows to an upstream side in the transport direction A of the portion P1, and the wrinkle W2 grows to a downstream side in the transport direction A of the portion P1, assuming that the portion P1 is an origin. As described above, tension in an oblique direction (tension in a direction intersecting the transport direction A) acts on the medium M, and thus the wrinkles W1 and W2 grow in the oblique direction (direction intersecting the transport direction A).

When wrinkles W1 and W2 grow assuming that the portion P1 is an origin, the medium M floats significantly upward from the medium supporting unit 40 or the medium guide unit 50.

When the wrinkle W1 grows on the upstream side in the transport direction A of the portion P1 and the medium M floats significantly upward from the medium supporting unit 40, a significant upward floating portion of the medium M due to the wrinkle W1 and the recording head 31 interfere, and there is a possibility of contamination of the medium M and deterioration in quality of an image formed on the medium M. Further, the significant upward floating portion of the medium M due to the wrinkle W1 and the recording head 31 interfere, and there is a possibility of a defect such as a failure of the recording head 31.

Further, when the wrinkle W2 grows on the downstream side in the transport direction A of the portion P1 and the medium M floats significantly upward from the medium guide unit 50, the medium M is wound by the winding unit 60 in a state where the medium M floats significantly upward from the medium guide unit 50. Then, a fold due to the significant upward floating of the medium M occurs in the roll body R2. When an image capable of being sublimation-transferred is formed on the medium M in a state where the fold has occurred, there is a possibility of deterioration in quality of an image (final product) formed by sublimation transfer. In addition, there is a possibility of disturbance of a winding shape of the roll body R2 wound by the winding unit 60.

Accordingly, the printing apparatus 100 according to the comparative example has such an issue that when the wrinkles W1 and W2 grow assuming that the portion P1 where the initial upward floating of the medium M occurs is an origin, there is a possibility of occurrence of defects such as deterioration in printing quality, a failure of the recording head 31, and disturbance of the winding shape.

Note that the initial upward floating of the medium M does not occur at one location in the portion P1, but occurs in many unspecified portions, and the wrinkle W grows in each of these many portions where the initial upward floating of the medium M occurs, and there is a possibility of occurrence of the above-described defects.

The wrinkles W1 and W2 growing where the portion P1 is assumed to be an origin include a portion floating upward from the medium supporting unit 40 or the medium guide unit 50, and a portion coming into contact with the medium supporting unit 40 or the medium guide unit 50. That is, the wrinkle W occurring in the medium M in the printing apparatuses 1 and 100 includes a portion coming into contact with the medium supporting unit 40 or the medium guide unit 50 in addition to the portion floating upward from the medium supporting unit 40 or the medium guide unit 50.

In the printing apparatus 100 according to the comparative example, a constituent element configured to inhibit the growth of the wrinkles W1 and W2 is not provided, and defects such as deterioration in printing quality, a failure of the recording head 31, and disturbance of the winding shape are likely to occur due to the wrinkles W1 and W2 growing where the portion P1 is assumed to be an origin.

On the other hand, in the printing apparatus 1 according to the exemplary embodiment, constituent elements (the second portion side convex portions 81 and the curved portion side convex portions 91) configured to inhibit the growth of the wrinkles W1 and W2 are provided, and thus defects such as deterioration in printing quality, a failure of the recording head 31, and disturbance of the winding shape are less likely to occur due to the wrinkles W1 and W2 growing where the portion P1 is assumed to be an origin.

That is, the printing apparatus 1 according to the exemplary embodiment includes an excellent configuration in which the issues of the printing apparatus 100 according to the comparative example become less likely to occur. The details of the printing apparatus 1 are described below.

The printing apparatus 1 according to the exemplary embodiment is provided with the second portion side convex portions 81 in the second portion 42, and the curved portion side convex portions 91 in the curved portion 51. The second portion side convex portions 81 are provided on an upstream side in the transport direction A of the portion where the initial upward floating of the medium M is likely to occur. The curved portion side convex portions 91 are provided on a downstream side in the transport direction A of the portion where the initial upward floating of the medium M is likely to occur.

The force FA pressing the medium M against the second portion side convex portions 81 acts on the medium M and thus, when the wrinkle W grows to the upstream side in the transport direction A, a portion of the wrinkle W coming into contact with the medium supporting unit 40 collides with the second portion side convex portions 81, and force (force in the transport direction A) inhibiting the growth of the wrinkle W acts from the second portion side convex portions 81 on the portion of the wrinkle W coming into contact with the medium supporting unit 40 and the growth of the wrinkle W to the upstream side in the transport direction A is inhibited. That is, when the force FA pressing the medium M against the second portion side convex portions 81 acts on the medium M, the second portion side convex portions 81 can more strongly inhibit the growth of the wrinkle W to the upstream side in the transport direction A, as compared to a case where the force FA pressing the medium M against the second portion side convex portions 81 does not act on the medium M.

The force FB pressing the medium M against the curved portion side convex portions 91 acts on the medium M and thus, when the wrinkle W grows to the downstream side in the transport direction A, a portion of the wrinkle W coming into contact with the medium guide unit 50 collides with the curved portion side convex portions 91, and force (force in a direction opposite to the transport direction A) inhibiting the growth of the wrinkle W acts from the curved portion side convex portions 91 on the portion of the wrinkle W coming into contact with the medium guide unit 50 and the growth of the wrinkle W to the downstream side in the transport direction A is inhibited. That is, when the force FB pressing the medium M against the curved portion side convex portions 91 acts on the medium M, the curved portion side convex portions 91 can more strongly inhibit the growth of the wrinkle W to the downstream side in the transport direction A, as compared to a case where the force FB pressing the medium M against the curved portion side convex portions 91 does not act on the medium M.

More specifically, as illustrated in FIG. 5, in the printing apparatus 1 according to the exemplary embodiment, the initial upward floating of the medium M occurs in the portion P1 positioned on an upstream side in the transport direction A of the curved portion 51. Then, the wrinkle W1 grows to the upstream side in the transport direction A, where the portion P1 is assumed to be an origin.

The force FA pressing the medium M against the second portion side convex portions 81 acts on the medium M, and thus the wrinkle W collides with the second portion side convex portions 81, and the growth of the wrinkle W to the upstream side in the transport direction A is inhibited. Then, the wrinkle W1 is spread into a wrinkle W1A growing in the same direction illustrated by a dashed line in the figure, and a wrinkle W1B growing in a different direction illustrated by a dot dash line in the figure. The growth of the wrinkles W1A and W1B to the upstream side in the transport direction A is inhibited by the second portion side convex portions 81, and thus the upward floating of the medium M from the medium supporting unit 40 becomes slight and in addition, the growth to the upstream side in the transport direction becomes less likely to occur, as compared to a case where the growth to the upstream side in the transport direction A is not inhibited by the second portion side convex portions 81.

As a result, the wrinkle W1 is less likely to reach the first portion 41, and significant upward floating of the medium M due to the wrinkle W1 becomes less likely to occur in the first portion 41. Thus, defects (deterioration in printing quality, a failure of the recording head 31, and the like) due the interference between the significant upward floating portion of the medium M and the recording head 31 become less likely to occur. Even when the wrinkle W1 reaches the first portion 41, the upward floating of the medium M in the first portion 41 becomes slight, and defects (deterioration in printing quality, a failure of the recording head 31, and the like) due to the interference between the upward floating portion of the medium M due to the wrinkle W1 and the recording head 31 become less likely to occur.

As illustrated in FIG. 6, the wrinkle W2 grows to the downstream side in the transport direction A, where the portion P1 is assumed to be an origin.

The force FB pressing the medium M against the curved portion side convex portions 91 acts on the medium M, and thus the wrinkle W2 collides with the curved portion side convex portions 91, and the growth of the wrinkle W2 to the downstream side in the transport direction A is inhibited. Then, the wrinkle W2 is spread into a wrinkle W2A growing in the same direction illustrated by a dashed line in the figure, and a wrinkle W2B growing in a different direction illustrated by a dot dash line in the figure. The growth of the wrinkles W2A and W2B to the downstream side in the transport direction A is inhibited by the curved portion side convex portions 91, and thus the upward floating of the medium M from the medium guide unit 50 becomes slight and in addition, the growth to the downstream side in the transport direction A becomes less likely to occur, as compared to a case where the growth to the downstream side in the transport direction A is not inhibited by the curved portion side convex portions 91.

As a result, a fold due to the significant upward floating of the medium M becomes less likely to occur in the roll body R2 wound by the winding unit 60, and deterioration in quality of an image (final product) formed by sublimation transfer becomes less likely to occur. Further, disturbance of the winding shape of the roll body R2 due to the significant upward floating of the medium M becomes less likely to occur.

Further, in the printing apparatus 1 according to the exemplary embodiment, the curved portion side convex portions 91 of the curved portion side convex portion group 90, and the second portion side convex portions 81 of the second portion side convex portion group 80 are disposed in a staggered pattern to positionally differ in the X direction.

When the curved portion side convex portions 91 and the second portion side convex portions 81 are disposed in a staggered pattern to positionally differ in the X direction, as compared to a case where the curved portion side convex portions 91 and the second portion side convex portions 81 are disposed along the Y direction to be the same in a position in the X direction, the wrinkle W growing where the portion in which the initial upward floating of the medium M has occurred is assumed to be an origin becomes likely to collide with at least one of the curved portion side convex portions 91 and the second portion side convex portions 81, and the growth of the wrinkle W can be inhibited reliably and defects (deterioration in printing quality, a failure of the recording head 31, disturbance of the winding shape, and the like) due to the wrinkle W can reliably be made less likely to occur.

Exemplary Embodiment 2

Figure 7:
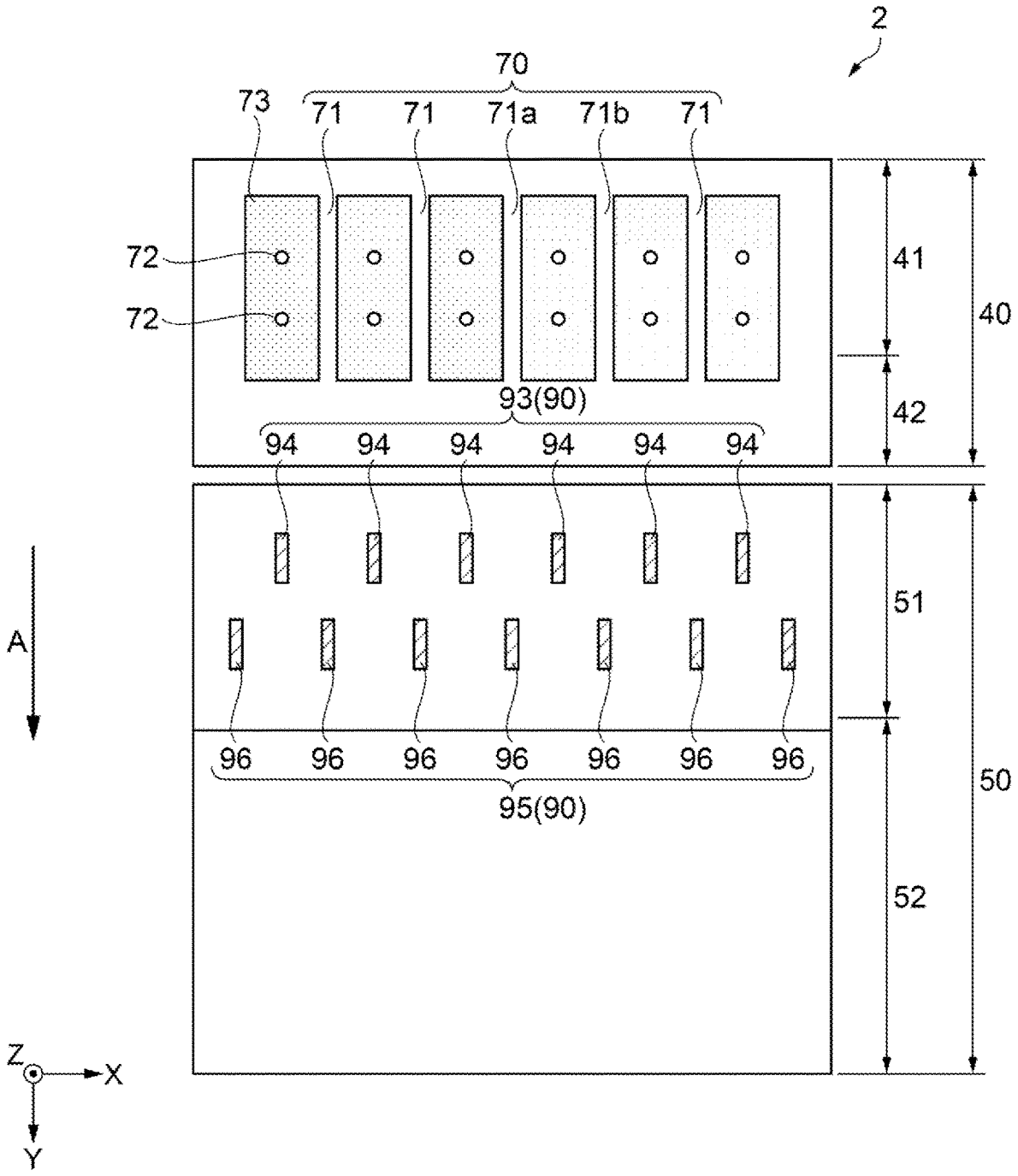
FIG. 7 is a schematic view illustrating a state of a medium supporting unit and a medium guide unit of a printing apparatus according to Exemplary Embodiment 2.
Figure 8:
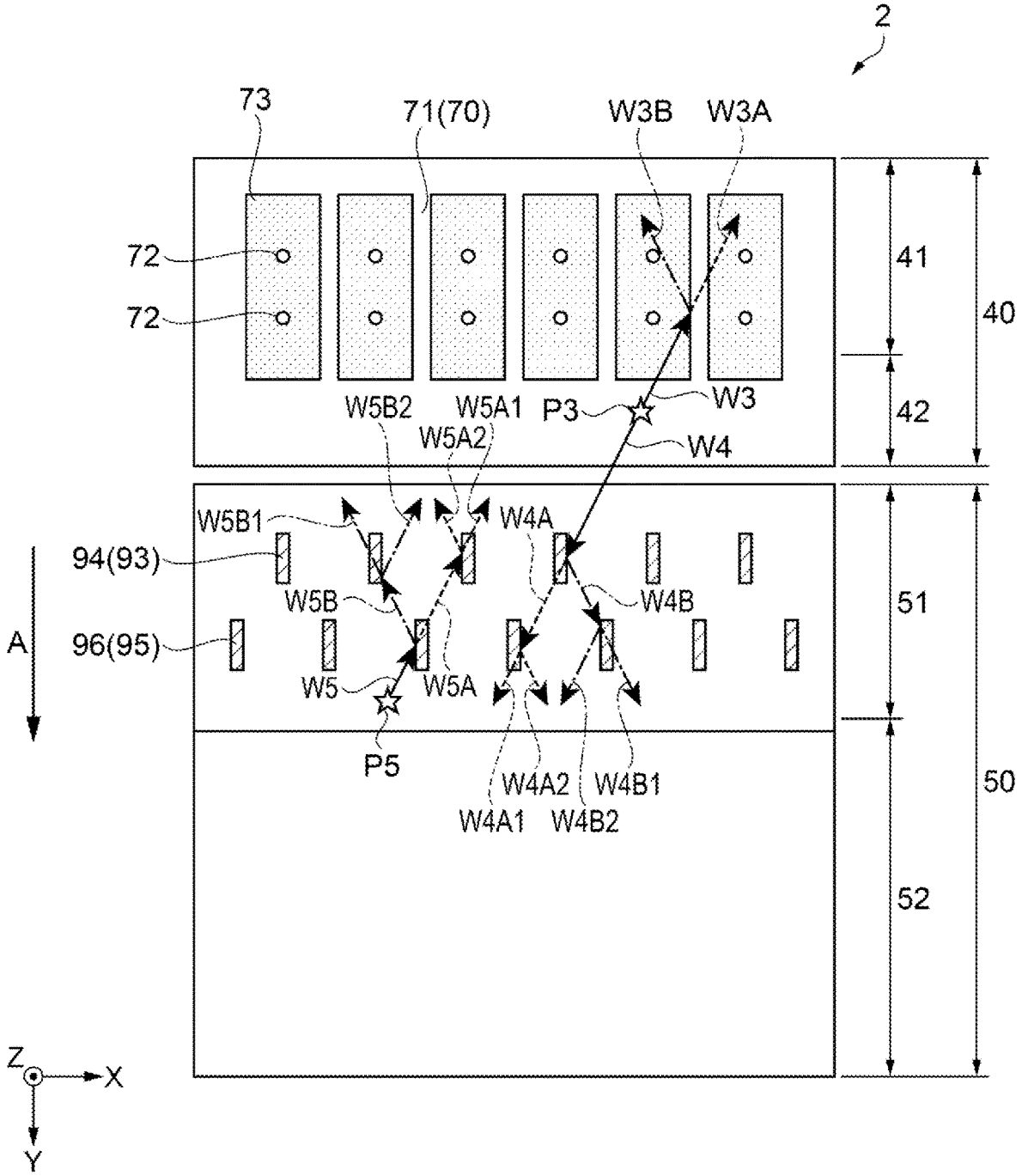
FIG. 8 is a schematic view illustrating a state of a wrinkle occurring in a medium in the medium supporting unit and the medium guide unit of the printing apparatus according to Exemplary Embodiment 2.

FIG. 7 is a figure corresponding to FIG. 3, and is a schematic view illustrating a state of a medium supporting unit and a medium guide unit of a printing apparatus according to Exemplary Embodiment 2. FIG. 8 is a figure corresponding to FIGS. 5 and 6, and is a schematic view illustrating a state of a wrinkle occurring in a medium in the medium supporting unit and the medium guide unit of the printing apparatus according to the exemplary embodiment.

A printing apparatus 2 according to this exemplary embodiment and the printing apparatus 1 according to the Exemplary Embodiment 1 differ in terms of constituent elements configured to inhibit growth of a wrinkle W and provided in a medium supporting unit 40 and a medium guide unit 50. This is a main difference between the printing apparatus 2 according to this exemplary embodiment and the printing apparatus 1 according to the exemplary embodiment.

With reference to FIG. 7 and FIG. 8, an overview of the printing apparatus 2 according to the exemplary embodiment will be described below by focusing on the differences from Exemplary Embodiment 1. Moreover, the same constituent elements as the constituent elements in Exemplary Embodiment 1 are denoted by the same reference signs, and descriptions of such constituent elements will be omitted.

In FIG. 7, each of the shaded portions is a concave portion 73 recessed in the Z (−) direction side, and each of non-shaded portions is a convex portion protruding in the Z (+) direction side.

As illustrated in FIG. 7, in a first portion 41 of the printing apparatus 2 according to the exemplary embodiment, the concave portions 73 recessed in the Z (−) direction side are formed along the X direction. First portion side convex portions 71 protruding in the Z (+) direction side are each formed between one of a plurality of the concave portions 73 and the concave portion 73 adjacent to the one of the concave portions 73. That is, in the first portion 41, the first portion side convex portions 71 protruding in a direction approaching a recording head 31 are arranged in the X direction.

Moreover, the first portion side convex portions 71 arranged in the X direction form a first portion side convex portion group 70.

In other words, the first portion 41 includes the first portion side convex portion group 70 including the first portion side convex portions 71 protruding in the direction approaching the recording head 31 and arranged in the X direction.

As viewed from the Z (+) direction side, each first portion side convex portion 71 has a rectangular shape with a dimension in the Y direction of the first portion side convex portion 71 longer than a dimension in the X direction of the first portion side convex portion 71. A position (height) of a surface of a top portion of the first portion side convex portion 71 coming into contact with a medium M is the same as a position (height) of a surface of a second portion 42 coming into contact with the medium M.

Note that the position of the surface of the top portion of the first portion side convex portion 71 coming into contact with the medium M may be configured to be different from the position of the surface of the second portion 41 coming into contact with the medium M. For example, the surface of the top portion of the first portion side convex portion 71 coming into contact with the medium M may be configured to be higher than the surface of the second portion 42 coming into contact with the medium M.

Further, the first portion side convex portion 71 may be formed across the second portion 42 in addition to the first portion 41.

A first portion side convex portion 71*a* in FIG. 7 is an example of "one of the first portion side convex portions arranged in the second direction", and is one of a plurality of the first portion side convex portions 71 provided along the X direction. A first portion side convex portion 71*b* in FIG. 7 is an example of a "first portion side convex portion adjacent to the one of the first portion side convex portions", and is the first portion side convex portion 71 adjacent to the first portion side convex portion 71*a*.

Two suction holes 72 passing through the first portion 41 are provided between the first portion side convex portion 71*a* and the first portion side convex portion 71*b*. In other words, the first portion 41 includes the suction holes 72 provided between the one first portion side convex portion 71*a* of the first portion side convex portions 71 arranged in the X direction, and the first portion side convex portion 71*b* adjacent to the one first portion side convex portion 71*a*.

Note that the number of the suction holes 72 provided between the first portion side convex portion 71*a* and the first portion side convex portion 71*b* is not limited to two, and may be singular or may be greater than two.

The medium M is suctioned and supported via the suction holes 72 in the first portion 41 by driving of a suction mechanism. Therefore, in the first portion 41, force pressing the medium M against the first portion side convex portions 71 acts on the medium M by the driving of the suction mechanism.

In the printing apparatus 2, the suction holes 72 are provided in the first portion 41 and thus, even when the medium M swells in a discharge range 35, the medium M is suctioned and supported via the suction holes 72 in the first portion 41, and upward floating of the medium M from the first portion 41 in the discharge range 35 is suppressed. Therefore, in the first portion 41, the upward floating of the medium M due to the swelling of the medium M is less likely to occur.

The second portion 42 includes no concave or convex portion formed, and is flat.

A curved portion 51 is provided with first curved portion side convex portions 94 and second curved portion side convex portions 96 in order along a transport direction A. A plurality of the curved portion side convex portions 94 and 96 are provided along the X direction. As viewed from the Z (+) direction side, the curved portion side convex portions 94 and 96 each have a rectangular shape, and a dimension in the Y direction of each of the curved portion side convex portions 94 and 96 is longer than a dimension in the X direction of each of the curved portion side convex portions 94 and 96.

The first curved portion side convex portions 94 (curved portion side convex portions 94) and the first portion side convex portions 71 are disposed in a staggered pattern to positionally differ in the X direction.

A plurality of the first curved portion side convex portions 94 provided along the X direction form a first curved portion side convex portion group 93. A plurality of the second curved portion side convex portions 96 provided along the X direction form a second curved portion side convex portion group 95. The first curved portion side convex portion group 93 is disposed on an upstream side in the transport direction A of the second curved portion side convex portion group 95, and the second curved portion side convex portion group 95 is disposed on a downstream side in the transport direction A of the first curved portion side convex portion group 93.

In other words, a curved portion side convex portion group 90 includes the first curved portion side convex portion group 93, and the second curved portion side convex portion group 95 disposed on the downstream side in the transport direction A of the first curved portion side convex portion group 93. Further, the first curved portion side convex portions 94 of the first curved portion side convex portion group 93, and the second curved portion side convex portions 96 of the second curved portion side convex portion group 95 are disposed in a staggered pattern to positionally differ in the X direction.

In the printing apparatus 2 according to the exemplary embodiment, initial upward floating of the medium M is assumed to occur in a portion P3 positioned in the second portion 42, and in a portion P5 positioned on a downstream side in the transport direction A of the curved portion 51.

As illustrated in FIG. 8, the initial upward floating of the medium M occurs in the portion P3 positioned in the second portion 42. Then, a wrinkle W3 grows to an upstream side in the transport direction A, and a wrinkle W4 grows to a downstream side in the transport direction A, where the portion P3 is assumed to be an origin.

Force pressing the medium M against the first portion side convex portions 71 acts on the medium M, and thus the wrinkle W3 collides with the first portion side convex portions 71, and the growth of the wrinkle W3 to the upstream side in the transport direction A is inhibited. Then, the wrinkle W3 spreads to become a wrinkle W3A growing in the same direction illustrated by a dashed line in the figure, and a wrinkle W3B growing in a different direction illustrated by a dot dash line in the figure. The growth of the wrinkles W3A and W3B to the upstream side in the transport direction A is inhibited by the first portion side convex portions 71, and thus upward floating of the medium M from the medium supporting unit 40 becomes slight and in addition, the growth to the upstream side in the transport direction A becomes less likely to occur, as compared to a case where the growth to the upstream side in the transport direction A is not inhibited by the first portion side convex portions 71.

As a result, in the first portion 41, upward floating of the medium M due to the wrinkle W3 becomes slight, and defects (deterioration in printing quality, a failure of the recording head 31, and the like) due to interference between an upward floating portion of the medium M due to the wrinkle W3 and the recording head 31 become less likely to occur.

Note that, when it is difficult to properly inhibit the wrinkle W growing to the upstream side in the transport direction A by the first portion side convex portions 71, it is preferable to provide the second portion side convex portion group 80 (refer to FIG. 3) including the second portion side convex portions 81 in the second portion 42 in addition to providing the first portion side convex portion group 70 including the first portion side convex portions 71 in the first portion 41.

When the second portion side convex portions 81 are provided in addition to the first portion side convex portions 71, the growth of the wrinkle W3 to the upstream side in the transport direction A is strongly inhibited, as compared to a case where only the first portion side convex portions 71 are provided, and the upward floating of the medium M due to the wrinkle W3 can be made slighter, and defects (deterioration in printing quality, a failure of the recording head 31, and the like) due to interference between the upward floating portion of the medium M due to the wrinkle W3 and the recording head 31 can be made less likely to occur.

Force FB pressing the medium M against the curved portion side convex portions 94 and 96 acts on the medium M, and thus a wrinkle W4 growing to the downstream side in the transport direction A where the portion P3 is assumed to be an origin collides with the first curved portion side convex portions 94, and the growth of the wrinkle W4 to the downstream side in the transport direction A is inhibited. Then, the wrinkle W4 spreads to become a wrinkle W4A growing in the same direction illustrated by a dashed line in the figure, and a wrinkle W4B growing in a different direction illustrated by a dot dash line in the figure. The growth of the wrinkles W4A and W4B to the downstream side in the transport direction A is inhibited by the first curved portion side convex portions 94, and thus upward floating of the medium M from the medium guide unit 50 becomes slight and in addition, the growth to the downstream side in the transport direction A becomes less likely to occur, as compared to a case where the growth to the downstream side in the transport direction A is not inhibited by the first curved portion side convex portions 94.

Further, the wrinkle W4A collides with the second curved portion side convex portions 96, and the growth of the wrinkle W4A to the downstream side in the transport direction A is also inhibited by the second curved portion side convex portions 96. Then, the wrinkle W4A spreads to become a wrinkle W4A1 growing in the same direction, and a wrinkle W4A2 growing in a different direction. The wrinkle W4B collides with the second curved portion side convex portions 96, and the growth of the wrinkle W4B to the downstream side in the transport direction A is also inhibited by the second curved portion side convex portions 96. Then, the wrinkle W4B spreads to become a wrinkle W4B1 growing in the same direction, and a wrinkle W4B2 growing in a different direction.

Accordingly, the growth of the wrinkle W4 to the downstream side in the transport direction A where the portion P3 is assumed to be an origin is inhibited by the two convex portions including the first curved portion side convex portion 94 and the second curved portion side convex portion 96, and thus the upward floating of the medium M from the medium guide unit 50 becomes slight, as compared to a case where the growth of the wrinkle W4 is inhibited by one convex portion.

As a result, a fold due to significant upward floating of the medium M becomes less likely to occur in a roll body R2 wound by a winding unit 60, and deterioration in quality of an image (final product) formed by sublimation transfer becomes less likely to occur. Further, disturbance of a winding shape of the roll body R2 due to the significant upward floating of the medium M becomes also less likely to occur.

As described above, strain due to shrinkage of the medium M is likely to accumulate in the curved portion 51 and is less likely to accumulate in a flat portion 52. Thus, when the initial upward floating of the medium M occurs in the portion P5 positioned on the downstream side in the transport direction A of the curved portion 51, the wrinkle W is less likely to grow to the downstream side (side opposite to the flat portion 52) in the transport direction A where the portion P5 is assumed to be an origin, and is likely to grow to the upstream side (side opposite to the flat portion 52) in the transport direction A where the portion P5 is assumed to be an origin. Therefore, a wrinkle W5 grows to the upstream side in the transport direction A where the portion P5 is assumed to be an origin.

Note that, in the flat portion 52, the strain accumulating in the medium M is slight and thus, when the wrinkle W grows to the downstream side (flat portion 52 side) in the transport direction A where the portion P5 is assumed to be an origin, the wrinkle is slight, and defects such as deterioration in quality of an image (final product) formed by sublimation transfer and disturbance of the winding shape of the roll body R2 are less likely to occur.

The wrinkle W5 growing to the upstream side in the transport direction A where the portion P5 is assumed to be an origin collides with the second curved portion side convex portions 96, and the growth of the wrinkle W5 to the upstream side in the transport direction A is inhibited. Then, the wrinkle W5 spreads to become a wrinkle W5A growing in the same direction illustrated by a dashed line in the figure, and a wrinkle W5B growing in a different direction illustrated by a dot dash line in the figure. The growth of the wrinkles W5A and W5B to the upstream side in the transport direction A is inhibited by the second curved portion side convex portions 96, and thus the upward floating of the medium M from the medium guide unit 50 becomes slight and in addition, the growth to the upstream side in the transport direction A becomes less likely to occur, as compared to a case where the growth to the upstream side in the transport direction A is not inhibited by the second curved portion side convex portions 96.

Further, the wrinkle W5A collides with the first curved portion side convex portions 94, and the growth of the wrinkle W5A to the upstream side in the transport direction A is also inhibited by the first curved portion side convex portions 94. Then, the wrinkle W5A spreads to become a wrinkle W5A1 growing in the same direction, and a wrinkle W5A 2 growing in a different direction. The wrinkle W5B collides with the first curved portion side convex portions 94, and the growth of the wrinkle W5B to the upstream side in the transport direction A is also inhibited by the first curved portion side convex portions 94. Then, the wrinkle W5B spreads to become a wrinkle W5B1 growing in the same direction, and a wrinkle W5B2 growing in a different direction.

Thus, the growth of the wrinkle W5 to the upstream side in the transport direction A where the portion P5 is assumed to be an origin is inhibited by the two convex portions of the first curved portion side convex portion 94 and the second curved portion side convex portion 96, and thus upward floating of the medium M due to the wrinkles W5A1, W5A2, W5B1, and W5B2 becomes slight, and the wrinkles W5A1, W5A2, W5B1, and W5B2 become less likely to grow to the upstream side in the transport direction A, as compared to a case where the growth of the wrinkle W5 is inhibited by one convex portion.

As a result, the wrinkles W5A1, W5A2, W5B1, and W5B2 are less likely to reach the first portion 41, and defects (deterioration in printing quality, a failure of the recording head 31, and the like) due to interference between a significant upward floating portion of the medium M and the recording head 31 become less likely to occur in the first portion 41. Even when the wrinkles W5A1, W5A2, W5B1, and W5B2 reach the first portion 41, the upward floating of the medium M in the first portion 41 becomes slight, and defects (deterioration in printing quality, a failure of the recording head 31, and the like) due to interference between an upward floating portion of the medium M due to the wrinkles W5A1, W5A2, W5B1, and W5B2 and the recording head 31 become less likely to occur.

The invention is not limited to the above-described exemplary embodiments, but can be changed appropriately without departing from the idea or the gist of the invention which can be appreciated from the claims and the entire specification, and a variety of modifications other than the above-described embodiments are conceivable. Hereinafter modifications will be described.

Modification 1

In Exemplary Embodiment 2, the two curved portion side convex portion groups (the first curved portion side convex portion group 93 and the second curved portion side convex portion group 95) are provided in the curved portion 51. The number of the curved portion side convex portion groups provided in the curved portion 51 is not limited to two, and may be singular or may be greater than two.

Moreover, a curved portion side convex portion group may be provided in the flat portion 52 in addition to the curved portion 51.

Modification 2

In Exemplary Embodiment 1, the control unit 7 is configured to control the rotational speed of the winding motor 62 and adjust tension acting on the medium M between the transporting unit 20 and the winding unit 60, but the exemplary embodiment is not limited to this configuration.

For example, a tension bar may be provided between the medium guide unit 50 and the winding unit 60, and configured to adjust tension acting on the medium M between the transporting unit 20 and the winding unit 60. That is, the tension bar may be configured to come into contact with a back surface of the medium M across the entire region in the width direction and press the medium M to apply tension to the medium M.

Modification 3

In Exemplary Embodiment 1, the heater 66 is attached to the surface (back surface) of the medium guide unit 50 on the side opposite to the medium M, and is configured to be driven to heat the medium M from the back side of the medium M by thermal conduction, but the exemplary embodiment is not limited to this configuration.

For example, an infrared heater disposed to face the surface (front surface) of the medium guide unit 50 on the medium M side may be provided, and the infrared heater may be configured to be heated to heat the medium M from the front side of the medium M by radiation.

The contents derived from the exemplary embodiments described above will be described below.

A liquid discharging device according to an aspect of the invention includes a transporting unit configured to transport a medium in a first direction, a winding unit disposed on a downstream side in the first direction of the transporting unit and configured to wind the medium, a discharging unit disposed between the transporting unit and the winding unit and configured to discharge a liquid onto the medium positioned in a discharge range, a first supporting unit disposed to face the discharging unit and configured to support the medium, and a second supporting unit disposed on a downstream side in the first direction of the first supporting unit, heated by a heater, and including a curved portion curved in a direction away from the discharging unit, and in the liquid discharging device, the curved portion includes a curved portion side convex portion group including curved portion side convex portions arranged in a second direction intersecting the first direction.

When the liquid is discharged from the discharging unit onto the medium, and the medium absorbs moisture of the liquid and swells, strain associated with the swelling of the medium accumulates in the medium. Further, when the medium loses the moisture and shrinks due to heating by the heater, strain associated with the shrinkage of the medium accumulates in the medium. When the strain accumulates in the medium, slight upward floating of the medium occurs, and further, a wrinkle (a portion of the medium floating significantly upward from the supporting unit) grows to the first direction side or the opposite direction side to the first direction where a portion in which the slight upward floating has occurred is assumed to be an origin.

When the wrinkle reaches the discharge region, a significant upward floating portion of the medium due to the wrinkle and the discharging unit interfere, and there is a possibility of occurrence of a defect such as contamination of the medium or a defect such as a failure of the discharging unit. Further, when the medium is wound by the winding unit in a state where the medium floats significantly upward, there is a possibility of occurrence of a fold in the medium or occurrence of disturbance in a winding shape of the medium.

When the curved portion side convex portions protruding in the direction approaching the discharging unit are provided in the curved portion, the wrinkle growing to the first direction side or to the opposite direction side to the first direction collides with the curved portion side convex portions, the growth of the wrinkle is inhibited by the curved portion side convex portions, and the upward floating of the medium due to the wrinkle becomes slight.

Therefore, even when the wrinkle becomes less likely to reach the discharge range or the wrinkle reaches the discharge range, the upward floating of the medium due to the wrinkle becomes slight. Hence, defects such as contamination of the medium and a failure of the discharging unit due to interference between the wrinkle (a portion of the medium floating upward from the supporting unit) and the discharging unit become less likely to occur.

Further, the upward floating of the medium due to the wrinkle becomes slight, and thus a fold in the medium or disturbance of the winding shape of the medium due to the medium being wound by the winding unit in a state where the medium significantly floats upward becomes less likely to occur.

According to another aspect of the invention, in the liquid discharging device, preferably the first supporting unit includes a first portion configured to support the medium positioned in the discharge range, and a second portion positioned on a downstream side in the first direction of the discharge range, and the second portion includes a second portion side convex portion group including second portion side convex portions arranged in the second direction, and a suction hole provided between one of the second portion side convex portions arranged in the second direction and a second portion side convex portion adjacent to the one of the second portion side convex portions.

When the second portion side convex portions protruding in the direction approaching the discharging unit are provided in the second portion, the wrinkle growing to the first direction side or to the opposite direction side to the first direction collides with the second portion side convex portions, the growth of the wrinkle is inhibited by the second portion side convex portions, and the upward floating of the medium due to the wrinkle becomes slight.

Therefore, even when the wrinkle becomes less likely to reach the discharge range or the wrinkle reaches the discharge range, the upward floating of the medium due to the wrinkle becomes slight. Hence, defects such as contamination of the medium and a failure of the discharging unit due to interference between the wrinkle (a portion of the medium floating upward from the supporting unit) and the discharging unit become less likely to occur.

According to a still further aspect of the invention, in the liquid discharging device, preferably the curved portion side convex portions and the second portion side convex portions are disposed in a staggered pattern to positionally differ in the second direction.

When the curved portion side convex portions and the second portion side convex portions are disposed in a staggered pattern to positionally differ in the second direction, the wrinkle growing to the first direction side or to the opposite direction side to the first direction becomes likely to collide with at least one of the curved portion side convex portions and the second portion side convex portions, as compared to a case where the curved portion side convex portions and the second portion side convex portions are disposed in the first direction to be the same in a position in the second direction.

According to a still further aspect of the invention, in the liquid discharging device, preferably the first supporting unit includes a first portion positioned in the discharge range, and a second portion positioned on the downstream side in the first direction of the discharge range, and the first portion includes a first portion side convex portion group including first portion side convex portions arranged in the second direction, and a suction hole provided between one of the first portion side convex portions arranged in the second direction and a first portion side convex portion adjacent to the one of the first portion side convex portions.

When the first portion side convex portions protruding in the direction approaching the discharging unit are provided in the first portion, the wrinkle growing to the first direction side or to the opposite direction side to the first direction collides with the first portion side convex portions, the growth of the wrinkle is inhibited by the first portion side convex portions, and the upward floating of the medium due to the wrinkle becomes slight.

According to a still further aspect of the invention, in the liquid discharging device, preferably the curved portion side convex portions and the first portion side convex portions are disposed in a staggered pattern to positionally differ in the second direction.

When the curved portion side convex portions and the first portion side convex portions are disposed in a staggered pattern to positionally differ in the second direction, the wrinkle growing to the first direction side or to the opposite direction side to the first direction becomes likely to collide with at least one of the curved portion side convex portions and the first portion side convex portions, as compared to a case where the curved portion side convex portions and the first portion side convex portions are disposed in the first direction to be the same in a position in the second direction.

According to a still further aspect of the invention, in the liquid discharging device, preferably the curved portion side convex portion group includes a first curved portion side convex portion group and a second curved portion side convex portion group disposed on a downstream side in the first direction of the first curved portion side convex portion group, and first curved portion side convex portions of the first curved portion side convex portion group and second curved portion side convex portions of the second curved portion side convex portion group are disposed in a staggered pattern to positionally differ in the second direction.

When the first curved portion side convex portions and the second curved portion side convex portions are disposed in a staggered pattern to positionally differ in the second direction, the wrinkle growing to the first direction side or to the opposite direction side to the first direction becomes likely to collide with at least one of the first curved portion side convex portions and the second curved portion side convex portions, as compared to a case where the first curved portion side convex portions and the second curved portion side convex portions are disposed in the first direction to be the same in a position in the second direction.

This application claims priority under 35 U.S.C. § 119 to Japanese Patent Application No. 2018-031644, filed Feb. 26 2018. The entire disclosure of Japanese Patent Application No. 2018-031644 is hereby incorporated herein by reference.

What is claimed is:

1. A liquid discharging device comprising:

a transporting unit configured to transport a medium in a first direction;

a winding unit disposed on a downstream side of the transporting unit in the first direction and configured to wind the medium;

a discharging unit disposed between the transporting unit and the winding unit and configured to discharge a liquid onto the medium positioned in a discharge range;

a first supporting unit disposed to face the discharging unit and configured to support the medium; and a second supporting unit disposed on a downstream side of the first supporting unit in the first direction, and heated by a heater, and moreover including a curved portion curved in a direction away from the discharging unit, wherein the curved portion includes a curved portion side convex portion group including curved portion side convex portions arranged in a second direction intersecting the first direction.

2. The liquid discharging device according to claim 1, wherein the first supporting unit includes a first portion configured to support the medium positioned in the discharge range, and a second portion positioned on a downstream side of the discharge range in the first direction, and the second portion includes a second portion side convex portion group including second portion side convex portions arranged in the second direction, and a suction hole provided between one of the second portion side convex portions arranged in the second direction and a second portion side convex portion adjacent to the one of the second portion side convex portions.

3. The liquid discharging device according to claim 2, wherein the curved portion side convex portions and the second side convex portions are disposed in a staggered pattern to positionally differ in the second direction.

4. The liquid discharging device according to claim 1, wherein the first supporting unit includes a first portion positioned in the discharge range, and a second portion positioned on the downstream side of the discharge range in the first direction, and the first portion includes a first portion side convex portion group including first portion side convex portions arranged in the second direction, and a suction hole provided between one of the first portion side convex portions arranged in the second direction and a first portion side convex portion adjacent to the one of the first portion side convex portions.

5. The liquid discharging device according to claim 4, wherein the curved portion side convex portions and the first portion side convex portions are disposed in a staggered pattern to positionally differ in the second direction.

6. The liquid discharging device according to claim 1, wherein the curved portion side convex portion group includes a first curved portion side convex portion group and a second curved portion side convex portion group disposed on a downstream side of the first curved portion side convex portion group in the first direction, and first curved portion side convex portions of the first curved portion side convex portion group and second curved portion side convex portions of the second curved portion side convex portion group are disposed in a staggered pattern to positionally differ in the second direction.

* * * * *